US009598749B2

(12) United States Patent
Oishi et al.

(10) Patent No.: US 9,598,749 B2
(45) **Date of Patent: *Mar. 21, 2017**

(54) ROLLED MAGNESIUM ALLOY MATERIAL, MAGNESIUM ALLOY STRUCTURAL MEMBER, AND METHOD FOR PRODUCING ROLLED MAGNESIUM ALLOY MATERIAL

(75) Inventors: Yukihiro Oishi, Osaka (JP); Nobuyuki Mori, Itami (JP); Ryuichi Inoue, Itami (JP); Masaaki Fujii, Itami (JP); Masahiko Ito, Itami (JP); Nozomu Kawabe, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 560 days.

This patent is subject to a terminal disclaimer.

(21) Appl. No.: 13/985,430

(22) PCT Filed: Feb. 13, 2012

(86) PCT No.: PCT/JP2012/053309

§ 371 (c)(1),
(2), (4) Date: Aug. 14, 2013

(87) PCT Pub. No.: WO2012/111633

PCT Pub. Date: Aug. 23, 2012

(65) Prior Publication Data

US 2013/0315778 A1 Nov. 28, 2013

(30) Foreign Application Priority Data

Feb. 14, 2011 (JP) ..... 2011-028608

(51) Int. Cl.
*C22F 1/06* (2006.01)
*C22C 23/00* (2006.01)
(Continued)

(52) U.S. Cl.
CPC ..... *C22C 23/00* (2013.01); *B21B 1/00* (2013.01); *C22C 23/02* (2013.01); *C22C 23/04* (2013.01);
(Continued)

(58) Field of Classification Search
CPC ... B21B 1/00; B21B 3/00; C22C 23/00; C22F 1/06
(Continued)

(56) References Cited

U.S. PATENT DOCUMENTS 8,828,158 B2 * 9/2014 Inoue ..... C22C 23/02 148/557
2008/0279715 A1 11/2008 Mori et al.
(Continued)

FOREIGN PATENT DOCUMENTS

CN 1850378 A 10/2006
CN 101678419 A 3/2010
(Continued)

OTHER PUBLICATIONS

Machine translation of JP2005-281848A, Oct. 2005.*
(Continued)

*Primary Examiner* — Jie Yang
(74) *Attorney, Agent, or Firm* — Ditthavong & Steiner, P.C.

(57) ABSTRACT

Provided are a rolled Mg alloy material whose mechanical properties are locally different in a width direction, a Mg alloy structural member produced by plastically working the rolled Mg alloy material, and a method for producing the rolled Mg alloy material. The method for producing a rolled Mg alloy material includes rolling a Mg alloy material with a reduction roll. The reduction roll has three or more regions in the width direction. The temperature is controlled in each of the regions so that a difference between a maximum
(Continued)

temperature and a minimum temperature exceeds 10° C. in the width direction of a surface of the reduction roll. The rolled state in the width direction is varied by varying a difference in temperature over the width direction of the reduction roll. As a result, it is possible to produce a rolled Mg alloy material whose mechanical properties are locally different in the width direction.

5 Claims, 1 Drawing Sheet

(51) Int. Cl.

| | |
|---|---|
| ***C22C 23/02*** | (2006.01) |
| ***C22C 23/04*** | (2006.01) |
| ***C22C 23/06*** | (2006.01) |
| ***B21B 1/00*** | (2006.01) |
| *B21B 3/00* | (2006.01) |

(52) U.S. Cl.
CPC ..... *C22C 23/06* (2013.01); *C22F 1/06* (2013.01); *B21B 3/00* (2013.01)

(58) Field of Classification Search
USPC ..... 420/402, 497; 148/420
See application file for complete search history.

(56) References Cited

U.S. PATENT DOCUMENTS

2011/0091349 A1 4/2011 Mori et al.
2013/0323523 A1* 12/2013 Oishi ..... C22C 23/02 428/544
2013/0333809 A1* 12/2013 Oishi ..... C22F 1/06 148/420

FOREIGN PATENT DOCUMENTS

| | | | | | |
|---|---|---|---|---|---|
| CN | 101688270 | A | | 3/2010 | |
| CN | 101811136 | A | | 8/2010 | |
| GB | 754935 | A | * | 8/1956 | ..... B29C 43/22 |
| JP | H11-192502 | A | | 7/1999 | |
| JP | 2001-252703 | A | | 9/2001 | |
| JP | 2005281848 | A | * | 10/2005 | |
| JP | 2006-130540 | A | | 5/2006 | |
| JP | 2007-044751 | A | | 2/2007 | |
| JP | 2007-098470 | A | | 4/2007 | |
| WO | 2005/098072 | A2 | | 10/2005 | |
| WO | 2011/065248 | A1 | | 6/2011 | |

OTHER PUBLICATIONS

Machine translation of JP2006130540A, May 2006.*
Notification of First Office Action for corresponding Chinese Patent Application No. 201280008839.9, dated Sep. 23, 2014.
International Search Report corresponding to Application No. PCT/JP2012/053309, mailed on Mar. 13, 2012.
Campbell, "Elements of Metallurgy and Engineering Alloys—27.4 Wrought Magnesium Alloys", ASM International, 2008.
Notification of First Office Action for corresponding Chinese Patent Application No. 201280008863.2, dated Aug. 5, 2014, 17 Pages.
International Search Report for PCT/JP2012/053308, mailing date of Mar. 13, 2012.

* cited by examiner (A)
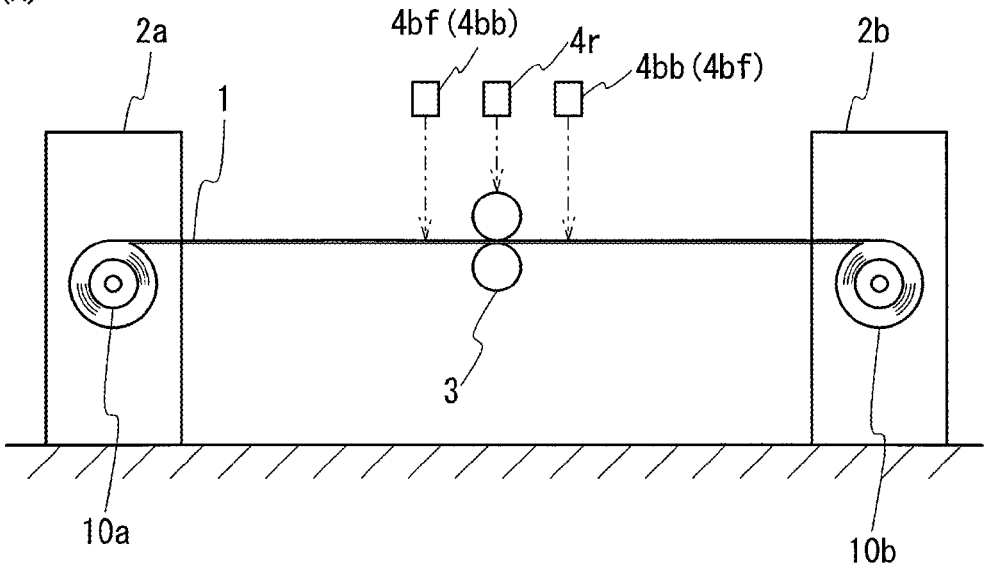
(B)
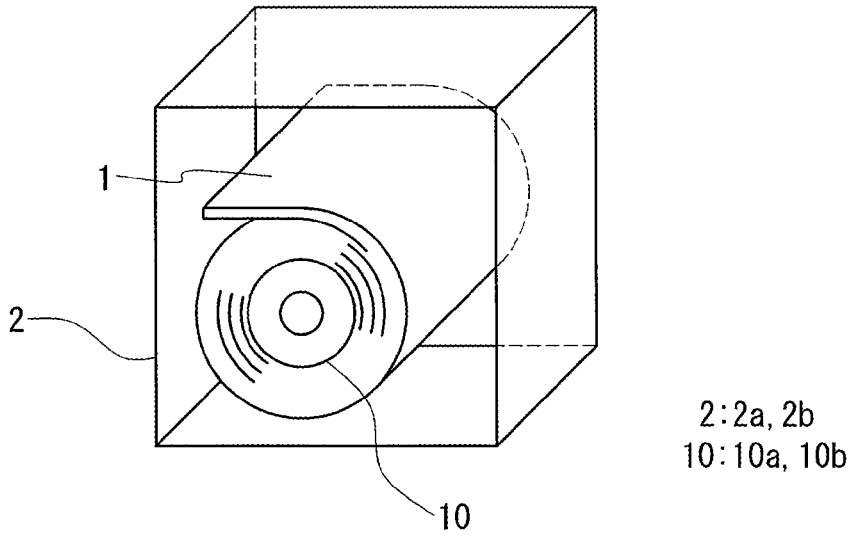

ROLLED MAGNESIUM ALLOY MATERIAL, MAGNESIUM ALLOY STRUCTURAL MEMBER, AND METHOD FOR PRODUCING ROLLED MAGNESIUM ALLOY MATERIAL

TECHNICAL FIELD

The present invention relates to a rolled magnesium alloy material, a magnesium alloy structural member, and a method for producing a rolled magnesium alloy material. In particular, the present invention relates to a rolled magnesium alloy material whose mechanical properties are partially different in a width direction of the rolled material, a magnesium alloy structural member obtained by plastically working the rolled magnesium alloy material, and a method for producing the rolled magnesium alloy material.

BACKGROUND ART

Recently, a magnesium (hereinafter, Mg) alloy sheet has been used in, for example, housings of cellular phones and laptop computers. Since Mg alloys have poor plastic workability, cast materials produced by die casting or thixomolding are mainly used. In general, such cast materials are subjected to, for example, rolling so as to improve the mechanical properties thereof.

PTL 1 describes that rolling is performed on a cast material composed of a magnesium alloy corresponding to the AZ91 alloy in the American Society for Testing and Materials (ASTM) standards, the cast material being produced by a twin-roll continuous casting process. Specifically, the rolling is performed while respectively controlling a surface temperature of a Mg alloy material sheet immediately before the sheet is inserted into reduction rolls and a surface temperature of the reduction rolls to specific temperatures.

CITATION LIST

Patent Literature

PTL 1: Japanese Unexamined Patent Application Publication No. 2007-098470

SUMMARY OF INVENTION

Technical Problem

With expansion of the range of applications of Mg alloys, for example, it has been desired to develop a Mg alloy material whose mechanical properties such as an elongation are locally different, so that when the Mg alloy material is locally subjected to plastic working, the plastic working can be easily performed. However, in the rolling described above, in the case where the Mg alloy material has a narrow width, a surface temperature of the Mg alloy material and a surface temperature of the reduction rolls naturally easily become uniform. As a result, the variation in the rolled state is difficult to generate in the width direction of the Mg alloy material, and thus a rolled Mg alloy material whose mechanical properties are uniform in the width direction tends to be provided. In other words, a Mg alloy material that locally exhibits good plastic workability only in a portion to be subjected to plastic working has not yet been developed.

The present invention has been made in view of the above circumstances, and an object of the present invention is to provide a rolled Mg alloy material whose mechanical properties are locally different in a width direction.

Another object of the present invention is to provide a Mg alloy structural member using the rolled Mg alloy material.

Another object of the present invention is to provide a method for producing the rolled Mg alloy material.

Solution to Problem

A rolled Mg alloy material of the present invention is produced by rolling a Mg alloy material with a reduction roll. In a width direction of the rolled material, a ratio $O_E/O_C$ of a basal plane peak ratio of an edge portion to a basal plane peak ratio of a central portion satisfies $O_E/O_C<0.89$, where the basal plane peak ratio $O_C$ of the central portion and the basal plane peak ratio $O_E$ of the edge portion are represented by formulae below:

$$\text{Basal plane peak ratio } O_C{:}I_C(002)/\{I_C(100)+I_C(002)+I_C(101)+I_C(102)+I_C(110)+I_C(103)\}$$

$$\text{Basal plane peak ratio } O_E{:}I_E(002)/\{I_E(100)+I_E(002)+I_E(101)+I_E(102)+I_E(110)+I_E(103)\}$$

In the formulae, $I_C(002)$, $I_C(100)$, $I_C(101)$, $I_C(102)$, $I_C(110)$, and $I_C(103)$ respectively represent X-ray diffraction peak intensities of a (002) plane, a (100) plane, a (101) plane, a (102) plane, a (110) plane, and a (103) plane in the central portion in the width direction of the rolled material, and $I_E(002)$, $I_E(100)$, $I_E(101)$, $I_E(102)$, $I_E(110)$, and $I_E(103)$ respectively represent X-ray diffraction peak intensities of the (002) plane, the (100) plane, the (101) plane, the (102) plane, the (110) plane, and the (103) plane in the edge portion in the width direction.

According to the rolled Mg alloy material of the present invention, since the ratio $O_E/O_C$ of the basal plane peak ratio of an edge portion to the basal plane peak ratio of a central portion of the rolled Mg alloy material satisfies the above range, it is possible to provide a rolled material whose strength in the central portion is higher than that in the edge portion and whose toughness (plastic workability) in the edge portion is higher than that in the central portion. Accordingly, the rolled Mg alloy material can be suitably used when the rolled Mg alloy material is locally subjected to plastic working, for example, when only an edge portion of the material is subjected to plastic working.

In the rolled material according to an embodiment of the present invention, an elongation ratio $E_E/E_C$ of the edge portion to the central portion may satisfy $3/2<E_E/E_C$, where $E_C$ denotes an elongation of the central portion in a tensile test in a rolling direction and $E_F$ denotes an elongation of the edge portion in a tensile test in a rolling direction.

In this case, since the elongation ratio $E_E/E_C$ of the elongation of the edge portion to the elongation of the central portion satisfies the above range, it is possible to provide a rolled Mg alloy material having an edge portion that is elongated more easily than the central portion. Accordingly, when the rolled Mg alloy material is locally subjected to plastic working, for example, when only an edge portion of the rolled Mg alloy material is subjected to plastic working, breaking etc. of the portion subjected to the plastic working can be suppressed.

In the rolled material according to an embodiment of the present invention, a tensile strength ratio $Ts_E/Ts_C$ of the edge portion to the central portion may satisfy $Ts_E/Ts_C<0.9$, where $Ts_C$ denotes a tensile strength of the central portion in a tensile test in a rolling direction and $Ts_E$ denotes a tensile strength of the edge portion in a tensile test in a rolling direction.

In this case, since the tensile strength ratio $Ts_E/Ts_C$ of the tensile strength of the edge portion to the tensile strength of the central portion satisfies the above range, it is possible to provide a rolled Mg alloy material in which the tensile strength in the central portion is higher than that in the edge portion.

In the rolled material according to an embodiment of the present invention, a 0.2% proof stress ratio $Ps_E/Ps_C$ of the edge portion to the central portion may satisfy $Ps_E/Ps_C<0.9$, where $Ps_C$ denotes a 0.2% proof stress of the central portion in a tensile test in a rolling direction and $Ps_E$ denotes a 0.2% proof stress of the edge portion in a tensile test in a rolling direction.

In this case, since the 0.2% proof stress ratio $Ps_E/Ps_C$ of the 0.2% proof stress of the edge portion to the 0.2% proof stress of the central portion of the rolled Mg alloy material satisfies the above range, it is possible to provide a rolled material in which plastic workability in the edge portion is higher than that in the central portion.

In the rolled material according to an embodiment of the present invention, an average grain size ratio $D_E/D_C$ of the edge portion to the central portion may satisfy $3/2<D_E/D_C$, where $D_C$ denotes an average grain size of the central portion of a cross section orthogonal to a rolling direction and $D_E$ denotes an average grain size of the edge portion of a cross section orthogonal to a rolling direction.

In this case, since the average grain size ratio $D_E/D_C$ of the average grain size of the edge portion to the average grain size of the central portion of the rolled Mg alloy material satisfies the above range, the average grain size of the edge portion is larger than that of the central portion. Therefore, the edge portion includes a small number of grain boundaries compared with the central portion, and thus has heat resistance higher than that of the central portion. On the other hand, the central portion includes a large number of grain boundaries compared with the edge portion, and thus has corrosion resistance and strength higher than those of the edge portion. Thus, it is possible to provide a rolled Mg alloy material whose mechanical properties are locally different in the width direction and in which the edge portion is more easily subjected to plastic working than the central portion.

In the rolled material according to an embodiment of the present invention, the magnesium alloy material may contain aluminum in an amount of 5% by mass or more and 12% by mass or less.

In this case, since the Mg alloy contains aluminum in an amount in the above range, a rolled Mg alloy material having a higher hardness and excellent corrosion resistance can be provided.

A Mg alloy structural member of the present invention is produced by plastically working the roiled Mg alloy material of the present invention.

In this case, since plastic working is performed on a portion having different mechanical properties in the width direction of the rolled Mg alloy material, it is possible to provide a Mg alloy structural member in which breaking etc. are not readily generated even when plastic working is performed and which has a good surface texture.

A method for producing a rolled Mg alloy material of the present invention includes a rolling step of rolling a magnesium alloy material with a reduction roll. The reduction roll has three or more regions in a width direction, and the temperature is controlled in each of the regions so that a difference between a maximum temperature and a minimum temperature exceeds 10° C. in the width direction of a surface of the reduction roll.

According to the production method of the present invention, by increasing the difference in temperature of reduction rolls over the width direction, the rolled state in the width direction can be varied. Accordingly, it is possible to produce a rolled Mg alloy material whose mechanical properties are locally different in the width direction.

In the production method according to an embodiment of the present invention, the temperature may be controlled by introducing, into the reduction roll, heat transfer oil whose temperature has been adjusted.

In this case, since the temperature is controlled by using heat transfer oil, the temperature can be rapidly controlled to a predetermined temperature in each of the regions from the inside of the reduction rolls.

In the production method according to an embodiment of the present invention, the temperature may be controlled by allowing a heating fluid whose temperature has been adjusted to adhere to the surface of the reduction roll.

In this case, since the temperature is controlled by allowing a heating fluid, whose temperature has been adjusted, to directly adhere to the surface of the rolls, the temperature can be finely controlled in the width direction of the reduction rolls, for example, in each of the regions and a portion that extends over adjacent regions. In addition, a temperature control mechanism need not be installed inside the reduction rolls. That is, even in existing reduction rolls that do not include a temperature control mechanism, the surface temperature of the reduction rolls can be easily controlled in each region from the outside of the rolls by using the heating fluid.

In the production method according to an embodiment of the present invention, the temperature may be controlled so that, on a surface of the rolled magnesium alloy material immediately after the magnesium alloy material passes through the reduction roll, a difference between a maximum temperature and a minimum temperature in the width direction exceeds 8° C.

In this case, by increasing the difference in temperature of the Mg alloy material over the width direction, the rolled state can be more effectively varied in the width direction of the Mg alloy material.

Advantageous Effects of Invention

A rolled Mg alloy material of the present invention has mechanical properties that are locally different in the width direction.

According to a Mg alloy structural member of the present invention, breaking, cracks, etc. are not readily generated, and the Mg alloy structural member has a good surface texture.

According to a method for producing a rolled Mg alloy material of the present invention, a rolled material having mechanical properties that are locally different in the width direction can be produced.

BRIEF DESCRIPTION OF DRAWINGS

FIG. 1 includes schematic views of a process for producing a rolled Mg alloy material according to an embodiment, part (A) is a view that schematically illustrates an example of a rolling line, and part (B) is a view that illustrates a heat box used for preheating a Mg alloy material.

DESCRIPTION OF EMBODIMENTS

Embodiments of the present invention will now be described. First, a rolled Mg alloy material will be described, and subsequently, a method for producing the rolled Mg alloy material will be described with reference to FIG. 1, as required.

<<Rolled Mg Alloy Material>>

[Composition]

Examples of a rolled Mg alloy material include materials having various compositions containing Mg as a main component, and additive elements added to the Mg (balance: inevitable impurities). In particular, in the present invention, Mg—Al alloys containing at least aluminum (Al) as an additive element are preferable. With an increase in the Al content, not only corrosion resistance tends to be high but also mechanical properties such as a strength and plastic deformation resistance tend to be high. Accordingly, in the present invention, Al is preferably contained in an amount of 3% by mass or more, 5% by mass or more, particularly preferably 7.0% by mass or more, and still more preferably 7.3% by mass or more. However, an Al content exceeding 12% by mass decreases plastic workability, and thus the upper limit of the Al content is 12% by mass. The Al content is particularly preferably 11% by mass or less, and still more preferably 8.3% to 9.5% by mass.

The additive elements other than Al may be at least one selected from zinc (Zn), manganese (Mn), silicon (Si), beryllium (Be), calcium (Ca), strontium (Sr), yttrium (Y), copper (Cu), silver (Ag), tin (Sn), nickel (Ni), gold (Au), lithium (Li), zirconium (Zr), cerium (Ce), and rare earth elements RE (excluding Y and Ce). In the case where these elements are contained, the content thereof is, for example, 0.01% by mass or more and 10% by mass or less in total, and preferably 0.1% by mass or more and 5% by mass or less in total. When, among these additive elements, at least one element selected from Si, Sn, Y, Ce, Ca, and rare earth elements (excluding Y and Ce) is contained in an amount of 0.001% by mass or more, and preferably 0.1% by mass or more and 5% by mass or less in total, good heat resistance and good flame retardancy are obtained. When rare earth elements are contained, the total content thereof is preferably 0.1% by mass or more. In particular, when Y is contained, the content thereof is preferably 0.5% by mass or more. An example of the impurities is Fe.

Examples of the specific compositions of the Mg—Al alloys include AZ alloys (Mg—Al—Zn alloys, Zn: 0.2% to 1.5% by mass), AM alloys (Mg—Al—Mn alloys Mn: 0.15% to 0.5% by mass), Mg—Al—RE (rare earth element) alloys, AX alloys (Mg—Al—Ca alloys, Ca: 0.2% to 6.0% by mass), and AJ alloys (Mg—Al—Sr alloys, Sr: 0.2% to 7.0% by mass) in the ASTM standards. In particular, a Mg—Al alloy containing 8.3% to 9.5% by mass of Al and 0.5% to 1.5% by mass of Zn, typically, the AZ91 alloy is preferable in view of good corrosion resistance and mechanical properties.

[Dimensions]

The width, the length, and the thickness of the rolled Mg alloy material may be appropriately selected in accordance with the size of a magnesium alloy structural member to be produced, and are not particularly limited. Examples of the rolled Mg alloy material include long materials and short materials produced by cutting a coil material to have an appropriate length. Regardless of the length of the rolled material, the rolled material preferably has a thickness that is substantially uniform in the width direction. In particular, a thickness ratio $t_E/t_C$ preferably satisfies $0.97 \leq t_E/t_C \leq 1.03$ where $t_C$ denotes a thickness of a central portion in the width direction of a rolled Mg alloy material and $t_E$ denotes a thickness of an edge portion in the width direction of the rolled Mg alloy material. When this range is satisfied, the thickness of a rolled Mg alloy material is uniform in the width direction. Accordingly, when the rolled Mg alloy material is wound as a coil, the occurrence of winding deviation can be suppressed. Herein, when the width is 300 mm or less, the term "central portion" refers to a range extending from the center in the width direction of a rolled material to positions spaced away from the center by about 5% or less, and total 10% or less of the width in directions towards the edges on both sides, and the term "edge portion" refers to a range extending from a side edge to near a position about 10% less, and preferably about 5% or less of the width from the side edge in a direction toward the center. On the other hand, when the width is more than 300 mm, the term "central portion" refers to a range extending from the center in the width direction to positions spaced away from the center by about 50 mm or less in directions towards the edges on both sides, and the term "edge portion" refers to a range extending from a side edge to near a position about 100 mm or less, and preferably about 50 mm or less from the side edge in a direction toward the center. Hereinafter, the term "central portion" and the term "edge portion" respectively refer to the same positions as the central portion and the edge portion defined above.

[Mechanical Properties]

In the rolled Mg alloy material of the present invention, physical values described below can be locally varied in the width direction by varying the rolled state in the width direction as described below. Positions having different physical values can be selected in the width direction without limitation by employing a production method described below. In this embodiment, a description will be made of, as an example, a case where physical values are different between the central portion and the edge portion in the width direction. Specific mechanical properties will be described below.

(Basal Plane Peak Ratio)

A basal plane peak ratio is determined by X-ray diffractometry with respect to a central portion and an edge portion in the width direction of a rolled Mg alloy material. Herein, a basal plane peak ratio $O_C$ in the central portion is represented by $I_C(002)/\{I_C(100)+I_C(002)+I_C(101)+I_C(102)+I_C(110)+I_C(103)\}$ on the basis of peak intensities $I_C(002)$, $I_C(100)$, $I_C(101)$, $I_C(102)$, $I_C(110)$, and $I_C(103)$ determined by X-ray diffraction of the (002) plane, the (100) plane, the (101) plane, the (102) plane, the (110) plane, and the (103) plane, respectively. Similarly, a basal plane peak ratio $O_E$ in the edge portion is represented by $I_E(002)/\{I_E(100)+I_E(002)+I_E(101)+I_E(102)+I_E(110)+I_E(103)\}$ on the basis of peak intensities $I_E(002)$, $I_E(100)$, $I_E(101)$, $I_E(102)$, $I_E(110)$, and $I_E(103)$ determined by X-ray diffraction of the (002) plane, the (100) plane, the (101) plane, the (102) plane, the (110) plane, and the (103) plane, respectively. When a ratio $O_E/O_C$ of the basal plane peak ratio of the edge portion to the basal plane peak ratio of the central portion determined as described above satisfies $O_E/O_C<0.89$, it is determined that the basal plane peak ratio is locally different in the width direction. In such a rolled Mg alloy material, the central portion has a strength higher than that in the edge portion, and the edge portion has toughness (plastic workability) higher than that in the central portion. Accordingly, such a rolled Mg alloy material can be suitably used when the rolled Mg alloy material is locally subjected to plastic working, for example, only the edge portion is subjected to plastic working. The lower limit of the ratio $O_E/O_C$ of the basal plane peak ratio is about 0.2. Regarding the positions measured by X-ray diffractometry, the measurement is performed on a surface in each of the central portion and the edge portion.

(Average Grain Size)

In each of the central portion and the edge portion, an average grain size on a cross section orthogonal to a rolling direction is determined in accordance with "Steels-Micrographic determination of the grain size JIS G 0551 (2005)". When an average grain size ratio $D_E/D_C$ satisfies $3/2<D_E/D_C$ where $D_E$ denotes the average grain size of the edge portion and $D_C$ denotes the average grain size of the central portion, it is determined that the average grain size is locally different in the width direction. In such a rolled Mg alloy material, the edge portion includes a small number of grain boundaries compared with the central portion, and thus has heat resistance higher than that of the central portion. On the other hand, the central portion includes a large number of grain boundaries compared with the edge portion, and thus has corrosion resistance and strength higher than those in the edge portion. That is, mechanical properties are locally different in the width direction, and the edge portion is more easily subjected to plastic working than the central portion. The upper limit of the average grain size ratio $D_E/D_C$ is about 2.

(Elongation·Tensile Strength·0.2% Proof Stress)

An elongation, a tensile strength, and a 0.2% proof stress are determined in each of the central portion and the edge portion in accordance with "Method of tensile test for metallic materials JIS Z 2241 (1998)". In each of the central portion and the edge portion, a JIS No. 13B specimen (JIS Z 2201 (1998)) is cut so that the longitudinal direction of the specimen corresponds to the rolling direction, and the tensile test is performed using the specimen.

When an elongation ratio $E_E/E_C$ satisfies $3/2<E_E/E_C$ where $E_E$ denotes the elongation of the edge portion and $E_C$ denotes the elongation of the central portion, it is determined that the elongation is locally different in the width direction. The upper limit of the elongation ratio $E_E/E_C$ is about 2.5.

Similarly, when a tensile strength ratio $Ts_E/Ts_C$ satisfies $Ts_E/Ts_C<0.9$ where $Ts_E$ denotes the tensile strength of the edge portion and $Ts_C$ denotes the tensile strength of the central portion, it is determined that the tensile strength is locally different in the width direction. The lower limit of the tensile strength ratio $Ts_E/Ts_C$ is about 0.8.

When a 0.2% proof stress ratio $Ps_E/Ps_C$ satisfies $Ps_E/Ps_C<0.9$ where $Ps_E$ denotes the 0.2% proof stress of the edge portion and $Ps_C$ denotes the 0.2% proof stress of the central portion, it is determined that the 0.2% proof stress is locally different in the width direction. The lower limit of the 0.2% proof stress ratio $Ps_E/Ps_C$ is about 0.8.

When the elongation, the tensile strength, and the 0.2% proof stress satisfy the above ranges, mechanical properties such as plastic workability can be locally varied in the width direction of the rolled material.

<Magnesium Alloy Structural Member>

A Mg alloy structural member is obtained by plastically working the rolled Mg alloy material of the present invention. Various types of working such as press working, deep-drawing, forging, and bending can be employed as the plastic working. Examples of the plastically worked Mg alloy structural member include structural members obtained by performing plastic working only on a part of the rolled Mg alloy material, and in particular, structural members, the edge portion of which is subjected to plastic working because the rolled Mg alloy material has an edge portion having good plastic workability. Specifically, the Mg alloy structural member covers an embodiment of a structural member having a portion that has been subjected to plastic working. The plastic working may be performed while the rolled material is heated at 200° C. to 300° C. In such a case, breaking etc. are not readily generated, and a Mg alloy structural member having a good surface texture is obtained.

The resulting Mg alloy structural member may be subjected to a surface texture-modifying treatment such as polishing, an anti-corrosion treatment such as a chemical conversion treatment or an anodization treatment, or a decorative surface treatment such as painting, thereby further improving corrosion resistance, providing mechanical protection, and enhancing the commercial value.

<<Method for Producing Rolled Mg Alloy Material>>

The above-described rolled Mg alloy material whose mechanical properties are locally different in the width direction is produced by rolling a Mg alloy material with reduction rolls. This rolling is performed as follows: As illustrated in FIG. 1(A), a Mg alloy material sheet 1 unwound from a reel 10*a* (10*b*) is rolled with reduction rolls 3, and the rolled material sheet 1 is taken up onto another reel 10*b* (10*a*). This operation is defined as one pass, and the operation is performed for a plurality of passes. In this embodiment, reverse rolling is performed in which the rotation direction of each reel 10*a* (10*b*) is reversed for every pass. Temperature sensors 4*r*, 4*bf*, and 4*bb* that respectively measure a surface temperature of the reduction rolls 3, a surface temperature of the material sheet 1 immediately before the material sheet 1 passes through the reduction rolls 3, and a surface temperature of the material sheet 1 immediately after the material sheet 1 passes through the reduction rolls 3 are provided. A feature of the production method of the present invention is that each of the reduction rolls has three or more regions in the width direction, and the temperature is controlled in each of the regions so that a difference between the maximum temperature and the minimum temperature in the width direction of a surface of the reduction roll exceeds 10° C., whereby the rolled Mg alloy material of the present invention can be obtained. The method will now be described in more detail.

[Preparation of Mg Alloy Material]

(Casting)

First, a Mg alloy material sheet 1 is prepared. A cast material (cast sheet) having the same composition as the composition of the rolled material described above can be suitably used as the Mg alloy material sheet 1. The cast material is produced by a continuous casting process, such as a twin-roll casting process, or die casting. In particular, since rapid solidification can be performed by the twin-roll casting process, internal defects such as oxides and segregated products can be reduced and it is possible to suppress the generation of cracks etc. originated from the internal defects during plastic working such as rolling. That is, the twin-roll casting process is preferable from the standpoint of producing a cast material having a good rolling property. In particular, in a Mg alloy material having a large Al content, impurities in crystal and precipitated impurities, and segregated products are easily generated during casting, and such impurities in crystal and precipitated impurities, and segregated products tend to remain in the material even after a process such as rolling is performed after casting. However, as described above, segregation etc. can be suppressed in a cast material produced by the twin-roll casting process, and thus such a cast material can be suitably used as a Mg alloy material. The thickness of the cast material is not particularly limited. However, when the thickness of the cast material is excessively large, segregation tends to occur.

Accordingly, the thickness is preferably 10 mm or less, more preferably 5 mm or less, and particularly preferably 4 mm or less. The width of the cast sheet is also not particularly limited, and a cast material having a width that can be produced with production equipment can be used. For rolling described below, a cast material having a width of 1,000 mm or less, furthermore, 500 mm or less is particularly useful. In this embodiment, a long cast material produced by casting is wound in the form of a coil to prepare a cast coil material, and the cast coil material is used in the subsequent step. During winding, the temperature of a winding start portion of the cast material may be about 100° C. to 200° C. In such a case, even an alloy in which breaking readily occurs, such as the AZ91 alloy, is easily bent and easily wound.

(Solution Treatment)

Rolling may be performed on the cast material. Alternatively, a solution treatment may be performed on the cast material before rolling, and the solution-treated material may be used as the Mg alloy material sheet 1. The cast material can be homogenized by the solution treatment. For example, the conditions for the solution treatment are as follows. The holding temperature is 350° C. or higher, and preferably 380° C. to 420° C., and the holding time is 30 to 2,400 minutes. With an increase in the Al content, it is preferable to increase the holding time. In a cooling step after the holding time, the cooling rate may be increased by using, for example, forced cooling such as water cooling or air blast. In this case, precipitation of coarse precipitates can be suppressed to produce a sheet having a good rolling property. In the case where a solution treatment is performed on a long cast material, the cast material may be wound in the form of a coil and the solution treatment may then be performed in this state, as in the cast coil material. In this case, the long cast material can be efficiently heated.

[Preheating]

The cast material or the Mg alloy material that has been subjected to a solution treatment is rolled to produce a rolled Mg alloy material having desired mechanical properties. Before rolling is performed on the Mg alloy material, the Mg alloy material may be preheated so that the Mg alloy material is easily rolled. For the preheating, for example, heating means such as a heat box 2 illustrated in FIG. 1(B) may be used. In this case, a long Mg alloy material can be heated at one time, which is good in terms of operation efficiency. The heat box 2 is an atmosphere furnace, which is an airtight container that can house the Mg alloy material sheet 1 wound in the form of a coil and in which hot air at a predetermined temperature is supplied and circulated in the container so that the inside of the container can be maintained at a desired temperature. The Mg alloy material sheet 1 may be taken from the heat box 2 without undergoing further treatment, and rolled. With this structure, in particular, it is possible to reduce the time until the heated Mg alloy material sheet 1 contacts the reduction rolls, thereby effectively suppressing a decrease in the temperature of the Mg alloy material sheet 1 that occurs until the Mg alloy material sheet 1 contacts the reduction rolls 3. Specifically, for example, the heat box 2 can house the Mg alloy material sheet 1 wound in the form of a coil, and rotatably support the reel 10 that can unwind and take up the Mg alloy material sheet 1. The Mg alloy material sheet 1 is housed in this heat box 2, and is heated to a particular temperature. FIG. 1(B) illustrates a state where a Mg alloy material sheet 1 wound in the form of a coil is housed in a heat box 2. Although the heat box 2 is used in a closed state in reality, for the sake of ease of understanding, the FIGURE illustrates a state where a front face is opened.

In the case where the Mg alloy material is preheated, heating is conducted so that the temperature of the Mg alloy material is 300° C. or lower. The preset temperature of the heating means such as a heat box can be selected from a range of 300° C. or lower. In particular, the preset temperature is preferably adjusted so that, immediately before the rolling, a surface temperature of the material is in the range of 150° C. to 300° C. through the all passes. When a Mg alloy material is rolled in a plurality of passes, the temperature of the Mg alloy material tends to be increased by heat generated by working. On the other hand, the temperature of the Mg alloy material may decrease until the Mg alloy material is unwound and contacts the reduction rolls. Accordingly, the present temperature of the heating means is preferably adjusted in consideration of the rolling speed (mainly, the traveling speed of the material during rolling), the distance from the heating means to the reduction rolls, the temperature of the reduction rolls, the number of passes, etc. The preset temperature of the heating means is preferably 150° C. to 280° C., in particular, 200° C. or higher, and particularly preferably 230° C. to 280° C. The heating time may be determined as a time until the Mg alloy material can be heated to a predetermined temperature. Furthermore, the heating time may be appropriately determined in consideration of the weight, the dimensions (width and thickness), the number of windings, etc. of the coil.

A surface temperature of the Mg alloy material sheet 1 may be measured before and after the Mg alloy material sheet 1 passes through the reduction rolls. Temperature sensors used therefor are arranged between the reel 10*a* and the reduction rolls 3, and between the reel 10*b* and the reduction rolls 3. For example, in FIG. 1(A), when a direction in which the material sheet 1 moves from the left side to the right side of the drawing is assumed to be an outward direction, the temperature sensor 4*bf* arranged on the left side of the reduction rolls 3 detects the surface temperature of the Mg alloy material sheet 1 immediately before the Mg alloy material sheet 1 passes through the reduction rolls 3, and the temperature sensor 4*bb* arranged on the right side of the reduction rolls 3 detects the surface temperature of the rolled sheet immediately after the sheet passes through the reduction rolls 3. On the other hand, when a direction in which the material sheet 1 moves from the right side to the left side of the drawing is assumed to be a return direction, the temperature sensor 4*bf* arranged on the right side of the reduction rolls 3 detects the surface temperature of the Mg alloy material sheet 1 immediately before the Mg alloy material sheet 1 passes through the reduction rolls 3, and the temperature sensor 4*bb* arranged on the left side of the reduction rolls 3 detects the surface temperature of the rolled sheet immediately after the sheet passes through the reduction rolls 3.

A surface temperature of the Mg alloy material sheet 1 preheated to the above temperature range may be measured by the temperature sensor 4*bf* before rolling. The temperature sensor 4*bf* may be a contact-type sensor that is brought into contact with the material sheet 1 to measure the temperature. The temperature sensor 4*bf* is preferably a non-contact-type sensor so as to prevent the material sheet from being damaged. The number and the positions of the temperature sensors 4*bf* arranged are appropriately selected so that the temperature of a portion which is to be subjected to plastic working after rolling or a portion whose plastic workability is to be increased (hereinafter referred to as "portion to be subjected to plastic working") and a portion other than the portion to be subjected to plastic working can be separately measured. For example, when portions which are to be subjected to plastic working are two edge portions, the temperature sensors 4*bf* may be arranged at three positions of the two edge portions and the central portion. A control, for example, a change in the heating temperature of the preheating or a change in the heating temperature of a heat-generating lamp described below may be performed on the basis of the temperatures measured by the sensors 4*bf*. Thus, temperature control, for example, varying the temperature in the width direction of the Mg alloy material sheet 1 is easily performed.

Auxiliary heating means (not illustrated) for reheating the Mg alloy material sheet 1 on the basis of the temperatures measured by the temperature sensors 4*bf* may be arranged. An example of the auxiliary heating means is a heat-generating lamp. The auxiliary heating means is arranged on the reel 10*a* (10*b*) side with respect to the temperature sensors 4*bf* (4*bb*). The number of the auxiliary heating means arranged is not particularly limited as long as the auxiliary heating means is arranged above the portion to be subjected to plastic working. With this structure, the temperature of the portion to be subjected to plastic working can be maintained to be higher than the temperature of other portions, thus improving plastic workability.

In the preheating including this reheating, the temperature distribution of the Mg alloy material sheet 1 may be uniform in the width direction. However, the temperature distribution is preferably varied from the standpoint that the difference in temperature in the width direction is easily generated during rolling. In the latter case, for example, the temperature of the portion to be subjected to plastic working is preferably the maximum temperature, and the temperature of the other portion is preferably the minimum temperature. In this case, even in a Mg alloy material with a narrow width, whose temperature distribution in the width direction is difficult to vary, the rolled state of the Mg alloy material sheet is easily varied. In the latter case, the rolled state of the Mg alloy material sheet may be varied by controlling the temperature of the reduction rolls described below.

[Rolling]

The Mg alloy material sheet 1 heated by heating means such as the heat box 2 is unwound from the heat box 2, supplied to the reduction rolls 3, and rolled. Specifically, for example, a rolling line illustrated in FIG. 1(A) is constructed. The rolling line includes a pair of reels 10*a* and 10*b* that can reverse their directions of rotation, and a pair of reduction rolls 3 which are arranged between the pair of reels 10*a* and 10*b* arranged with a space therebetween, and which are arranged so as to face each other and to sandwich the traveling Mg alloy material sheet 1 therebetween. A coil-shaped Mg alloy material sheet 1 is arranged in a reel 10*a* and is unwound, and an end of the Mg alloy material sheet 1 is taken up by the other reel 10*b*, whereby the Mg alloy material sheet 1 travels between the reels 10*a* and 10*b*. During this traveling, the Mg alloy material sheet 1 can be rolled by being sandwiched between the reduction rolls 3. In the example illustrated in FIG. 1(A), the reels 10*a* and 10*b* are housed in heat boxes 2*a* and 2*b*, respectively, and the Mg alloy material sheet 1 wound on the reels 10*a* and 10*b* can be heated by the heat boxes 2*a* and 2*b*. The heated Mg alloy material sheet 1 is unwound from one of the reels and taken out from one of the heat boxes, travels toward the other heat box, and is taken up by the other reel.

In this embodiment, the two ends of the Mg alloy material sheet 1 are taken up by the reels 10*a* and 10*b*, and an intermediate region other than the regions taken up by the reels 10*a* and 10*b* at both ends is introduced into the reduction rolls 3 and subjected to rolling in a plurality of passes. The rolling in each pass is performed by reversing the rotation direction of the reels 10*a* and 10*b* in every pass. Specifically, reverse rolling is performed. Accordingly, the Mg alloy material sheet 1 is not detached from the reels 10*a* and 10*b* until the final pass.

In FIG. 1, the number of reduction rolls 3 is illustrative. A plurality of pairs of reduction rolls may be arranged in a direction in which the Mg alloy material sheet 1 travels.

The reduction rolls 3 are heated so that a surface temperature thereof specifically becomes in the range of 230° C. to 290° C. When the surface temperature is 230° C. or higher, the material sheet can be sufficiently maintained in a heated state, and thus the material sheet can be in a state of good plastic workability and rolling can be satisfactorily performed. When the surface temperature is 290° C. or lower, coarsening of the grain size of the material sheet and releasing of work strain introduced by rolling are suppressed, and a rolled sheet having good press workability can be produced.

In the above temperature range, the temperature is controlled so that the difference between the maximum temperature and the minimum temperature in the width direction of a surface of a reduction roll exceeds 10° C. Herein the phrase "difference between the maximum temperature and the minimum temperature in the width direction" refers to a difference between the maximum temperature and the minimum temperature in a region which is disposed on the surface of the reduction roll and through which the Mg alloy material sheet 1 passes. Specifically, the temperature of the surface of the reduction roll is preferably controlled so that the surface temperature of a portion to be subjected to plastic working becomes higher than that of a portion other than the portion to be subjected to plastic working. In this embodiment, the temperature of two edge portions in the width direction is made higher than the temperature of the central portion. By increasing the difference in temperature over the width direction of the reduction rolls 3, the rolled state in the width direction can be varied. Specifically, the mechanical properties of the rolled Mg alloy material can be locally varied in the width direction. The difference between the maximum temperature and the minimum temperature is up to about 20° C.

The temperature is preferably controlled so that, in the width direction of the reduction rolls 3, a difference in temperature between two arbitrary points exceeds 6° C. For example, in particular, these two arbitrary points may be located in a portion to be subjected to plastic working and in a portion other than the portion to be subjected to plastic working. By increasing the difference in temperature between these two points, the temperature distribution over the width direction of the reduction rolls 3 can be easily varied. As a result, the rolled state of the Mg alloy material can be effectively varied. The distance between the two points is appropriately selected in accordance with the shape of a plastically worked product obtained after rolling.

The temperature of the material immediately before the material is supplied to the reduction rolls 3 is checked by the temperature sensor 4*bf*, and temperature control, for example, a change in the temperature of the reduction rolls 3 may also be performed on the basis of the measured temperature. In such a case, rolling is easily performed while varying the temperature in the width direction of the Mg alloy material, and the rolled state is easily varied in the width direction of the Mg alloy material. The temperature of the reduction rolls 3 is also checked by the temperature sensor 4*r*. The temperature sensor 4*r* may also be a contact-type sensor that is brought into contact with a roll 3 to measure the temperature or a non-contact-type sensor. The number and the positions of the temperature sensors 4*r* arranged are appropriately selected so that the temperatures of at least three positions including a central portion and two edge portions in the width direction of the roll 3 can be measured. For example, three temperature sensors 4*r* may be arranged above the central portion and the two edge portions to measure the temperatures of each of these portions.

Furthermore, the temperatures of the material sheet 1 immediately after the material sheet 1 passes through the reduction rolls 3 are also checked by the temperature sensors 4*bb* in the same manner. It is preferable to perform temperature control, for example, appropriately change the heating temperature of the reduction rolls 3 on the basis of the temperatures measured by the temperature sensors 4*bb*. Thus, the temperature over the width direction of the Mg alloy material sheet 1 is easily controlled. It is sufficient that when the measurement is performed with the temperature sensors 4*bb*, the difference between the maximum temperature and the minimum temperature in the width direction of the Mg alloy material sheet 1 exceeds 8° C. That is, it is preferable to control the temperature of the reduction rolls 3 so as to satisfy the above condition. By increasing the difference in temperature between these two pointes, the temperature distribution over the width direction of the reduction rolls is easily varied. As a result, the rolled state of the Mg alloy material can be effectively varied.

When the temperature distribution in the width direction of a reduction roll 3 is varied as described above, a reduction roll diameter of a portion at which the temperature becomes the maximum temperature in the width direction of the reduction roll 3 is preferably made smaller than a reduction roll diameter of another portion, in particular, a portion at which the temperature becomes the minimum temperature. Specifically, the difference in diameter is preferably designed in consideration of a difference in thermal expansion between portions on the surface of the reduction roll 3, the temperatures of which become the respective values, on the basis of the difference between the maximum temperature and the minimum temperature of the reduction roll 3 and a coefficient of thermal expansion of the material constituting the reduction roll 3. In such a case, when the Mg alloy material sheet 1 is rolled, it is possible to suppress the variation in the thickness in the width direction of the resulting rolled Mg alloy sheet.

It is believed that the temperature of the whole material sheet 1 wound in the form of a coil does not easily decrease during the transport and installation of the material sheet 1 because the whole material sheet 1 has a heat capacity higher than that of an unwound part of the material sheet 1. In contrast, it is believed that a decrease in the temperature of the material sheet 1 from the time when the material sheet 1 is unwound from a reel 10 or a supply device to the time when the material sheet 1 contacts the reduction rolls 3 is relatively significant. The reason for this is believed to be that such a material sheet 1 is a part of the material as described above and has a low heat capacity, and that the magnesium alloy is a metal having good thermal conductivity and easily cools. The degree of decrease in the temperature of the material sheet 1 until the material sheet 1 contacts the reduction rolls 3 is affected by the thickness of the material sheet 1, the traveling speed of the material sheet 1, etc. The smaller the thickness of the sheet and the lower the rolling speed, the more easily the temperature decreases. It is preferable to supply the material sheet 1 to the reduction rolls 3 before the surface temperature of the material sheet 1 becomes lower than 170° C., preferably at a surface temperature of the material sheet 1 of 180° C. or higher, and particularly preferably 210° C. or higher. The rotation speed (peripheral speed) of the reduction rolls 3 is appropriately adjusted in accordance with the traveling speed of the material. When the rotation speed of the reduction rolls 3 is, for example, 5 to 200 m/min, the rolling can be efficiently performed.

In order to control the temperature of a surface of the reduction rolls 3 as described above, the reduction rolls 3 each have three or more regions in the width direction, and the temperature is controlled in each of the regions. As means for controlling the temperature, for example, a heater such as a cartridge heater may be provided in the reduction rolls 3 (heater method), a liquid such as heated oil (heat transfer oil) may be introduced into the reduction rolls or circulated in the rolls (liquid-circulating method), or a heating fluid whose temperature has been adjusted may be directly allowed to adhere. As specific means for allowing a heating fluid to directly adhering to the reduction rolls 3, for example, gas such as hot air may be blown (hot air method) or a lubricant or the like described below may be applied. Among these methods, in particular, when the reduction rolls 3 are heated by circulating heated oil inside the reduction rolls 3, the reduction rolls 3 can be uniformly filled with the heated liquid in the width direction and the circumferential direction. Thus, the temperature can be rapidly controlled to a predetermined temperature from the inside of the reduction rolls 3 in each of the regions, and the difference between the maximum temperature and the minimum temperature in the width direction of the rolls can be easily reduced to the above range. The temperature of the liquid circulated is preferably the preset surface temperature of the reduction rolls 3 plus about 10° C., though it depends on the dimensions (width and diameter) and the material of the reduction rolls 3, and the widths and the positions of the regions. For example, a liquid circulation mechanism used in a water-cooled copper or the like can be applied to the circulation of the liquid. In the heater method, a plurality of heaters are preferably adjusted and housed in each of the regions in order to increase the variation in the temperature in the width direction of the reduction rolls 3. Specifically, it is preferable to change the number of heaters or to change the temperatures of the heaters in the central portion of the roll where the heated state is easily maintained and in the edge portions of the roll where the heated state is difficult to be maintained. A sliding contact may be used for electrical connection between each heater side and the power supply side in the rotation axis of each of the reduction rolls 3. In the hot air method, the temperature of the gas, the amount of blowing, the number of gas outlets, the arrangement positions of the gas outlets, etc. may be adjusted.

In the rolling of each pass, the rolling reduction per pass can be appropriately selected. The rolling reduction per pass is preferably 10% or more and 40% or less, and the total rolling reduction is preferably 75% or more and 85% or less. By rolling a material a plurality of times (in a plurality of passes) with rolls at such a rolling reduction, a desired thickness of the resulting rolled sheet can be obtained, the average grain size can be reduced, press workability can be enhanced, and the generation of defects such as surface cracks can be suppressed.

In the rolling, a lubricant is preferably used because friction between the material and the reduction rolls can be reduced, and the rolling can be satisfactorily performed. The lubricant may be applied onto the reduction rolls as required.

However, it was found that, for some types of lubricants, a lubricant remaining on the material is burned by heat in the subsequent preheating step or by heat due to contact with the reduction rolls, and an affected layer is formed. It was also found that, when such an affected layer is present, the thickness of the material may vary, and the material may meander or travel in an inclined manner in one direction (transversely moves) because of the variation in the thickness, which may easily cause significant winding deviation. Furthermore, it was also found that the lubricant tends to remain on the two edge portions rather than the central portion in the width direction of the material, though details of the mechanism responsible for this are not clear. Therefore, it is preferable to use a lubricant that does not form an affected layer at 290° C., which is the maximum of the heating temperature of the reduction rolls, and in consideration of a margin, about 300° C. In order to prevent a lubricant or an affected layer from being locally present on the material as described above, the lubricant on the surface of the material is preferably leveled immediately before the material is supplied to the reduction rolls. For example, leveling means such as a brush or a wiper may be arranged on the upstream side of the reduction rolls so as to level unevenness of the lubricant on the surface of the material.

In order to adjust the tension applied to the material sheet 1 during rolling, pinch rollers (not illustrated) may be arranged at the upstream side and the downstream side of the reduction rolls 3. In order to prevent a decrease in the temperature of the material due to contact with the pinch rolls, the pinch rolls are preferably heated to about 200° C. to 250° C.

(Winding)

The rolled sheet obtained after rolling is wound in the form of a coil. A series of steps including the preheating step, the rolling step, and this winding step are continuously repeatedly performed, thus conducting rolling with rolls a desired number of times. The resulting rolled sheet (magnesium alloy sheet) is then finally wound in the form of a coil. The magnesium alloy sheet constituting the resulting coil material has a structure including work strain (shear band) introduced by rolling. Since the magnesium alloy sheet has such a structure, dynamic recrystallization occurs in the magnesium alloy sheet during plastic working such as press working and thus the magnesium alloy sheet has good plastic workability. In particular, in the rolling of the final pass, when the rolled sheet is wound while the temperature of the rolled sheet immediately before winding is controlled to a temperature at which recrystallization does not occur, specifically, a temperature of 250° C. or lower, a magnesium alloy sheet having good flatness can be obtained and the magnesium alloy sheet can have a structure in which the work strain sufficiently remains. In order to control the temperature of the rolled sheet immediately before winding to a temperature at which recrystallization does not occur, the traveling speed of the material may be adjusted. Alternatively, the rolled sheet may be cooled by forced cooling such as air blast. In this case, the temperature can be adjusted to a predetermined temperature within a short time, which is good in terms of operation efficiency.

(Straightening Step)

The wound coil material can be used as a product (typically, a raw material of a magnesium alloy material, such as a plastic working material) without undergoing further treatment. Furthermore, this coil material may be unwound, a predetermined bending may be provided to the rolled sheet, and thus straightening of work strain introduced by rolling may be performed. A roller leveler can be suitably used in the straightening. The roller leveler includes at least one pair of rollers facing each other, and provides bending by allowing a material to insert between the rollers. In particular, a roller leveler that can be suitably used is one that includes a plurality of rollers arranged in a zigzag manner and that can repeatedly provide bending to a rolled sheet by allowing the rolled sheet to pass between the rollers. By conducting such straightening, a magnesium alloy sheet having excellent flatness can be produced. In addition, since the work strain is sufficiently present, the magnesium alloy sheet can have good plastic workability such as press workability. Warm straightening may be performed in which bending is provided to a rolled sheet using heated rollers including heating means such as a heater. In this case, cracks etc. are not readily generated. The temperature of the rollers is preferably 100° C. or higher and 300° C. or lower. The amount of bending provided by the straightening can be adjusted by adjusting the size and the number of rollers, the distance (gap) between rollers arranged so as to face each other, the distance between rollers that are adjacent in a direction in which the material travels, and the like. The magnesium alloy sheet (rolled sheet) serving as a material may be heated in advance before the straightening is performed. A specific heating temperature is 100° C. or higher and 250° C. or lower, and preferably 200° C. or higher.

The magnesium alloy sheet subjected to the straightening step can be used as a product (typically, a raw material of a magnesium alloy material, such as a plastic working material) without undergoing further treatment. In order to further improve the surface state, surface polishing may be performed by using a polishing belt or the like.

Operations and Advantages

According to the rolled Mg alloy material and the method for producing a rolled Mg alloy material according to the above embodiments, the following advantages are achieved.

(1) The mechanical properties are locally different in the width direction of a rolled material. Accordingly, only a portion to be subjected to plastic working locally has good plastic workability, and thus the rolled material of the present invention can be suitably used in the case where plastic working is performed on a desired portion.

(2) According to the production method described above, the rolled state in the width direction of a rolled material is varied by varying the difference in temperature over the width direction of reduction rolls. Therefore, it is possible to produce a rolled Mg alloy material whose mechanical properties are locally different in the width direction.

Test Examples

As test examples, the following rolled Mg alloy materials are prepared and mechanical properties thereof are examined. First, a Mg alloy material sheet having a composition corresponding to AZ91 containing Mg-9.0 mass % Al-1.0 mass % Zn, and a Mg alloy coil material having a composition corresponding to AZ31 containing Mg-3.0 mass % Al-1.0 mass % Zn are produced by twin-roll casting. These coil materials each have a thickness of 5.0 mm, a width of 320 mm, and a length of 100 m. A solution treatment is performed at 400° C. for 20 hours on each of the samples prior to rolling. Subsequently, rolling is performed under the conditions described below. Thus, samples 1 to 4 composed of AZ91 and samples 5 to 8 composed of AZ31 were prepared.

(Rolling Conditions)

Rolling in a plurality of passes, rolling reduction: 15% to 25%/pass

Final thickness: Rolling was performed until the thickness became 0.8 mm (width: 300 mm), total rolling reduction: 84%

Method for heating reduction rolls: Heated from the outside of the rolls

In this test, prior to rolling, for samples 1 to 4, the Mg alloy material sheet was preheated at a preset temperature of a heating device (heat box) of about 260° C., and for samples 5 to 8, the Mg alloy material sheet was preheated at a preset temperature of about 230° C. Rolling was then performed on each of the samples. Accordingly, it is believed that immediately before the Mg alloy material sheet of each sample is introduced into reduction rolls, the Mg alloy material sheet has a temperature distribution in which the temperature is low on the two edge sides in the width direction of the material sheet and the temperature is high on the center side in the width direction. After the final rolling and immediately before the rolled Mg alloy sheet was taken up, trimming was performed to adjust the width of the rolled Mg alloy sheet to the above value. Note that trimming can be performed at an appropriate stage before or after rolling.

Reduction rolls were heated by the following method. The reduction rolls were each substantially equally divided into three regions in the width direction thereof, and a lubricant whose temperature had been adjusted was directly applied onto the three regions. In sample 1, the lubricant whose temperature had been adjusted to 235° C. to 245° C. was applied onto the center of the three regions, and the lubricant whose temperature had been adjusted to 250° C. to 260° C. was applied onto both sides of the center so that a roll surface temperature of an edge portion in the width direction was higher than that of a central portion. On the other hand, in sample 5, the lubricant whose temperature had been adjusted to 205° C. to 215° C. was applied onto the center, and the lubricant whose temperature had been adjusted to 220° C. to 230° C. was applied onto both sides of the center so that a roll surface temperature of an edge portion in the width direction was higher than that of a central portion.

In performing rolling, the temperature of a surface of the reduction roll and the temperature of a surface of the rolled Mg alloy sheet immediately after rolling were measured and determined as follows. In a region on the surface of the reduction roll that the material sheet contacts, an arbitrary straight line is set along a width direction (direction parallel to the axial direction) of the roll, and the temperature is measured at a plurality of points along the straight line. In this example, the arbitrary straight line was set on each of the surface of the reduction roll and the surface of the rolled Mg alloy material. Along the straight line, a total of 3 points including points 50 mm, 160 mm, and 260 mm from an edge in the width direction were determined, and the temperatures of the respective points were measured by non-contact type temperature sensors. In this measurement, the temperatures of the surface of the reduction roll are measured at positions on the surface of the reduction roll, the positions being shifted from a region where the lubricant is sprayed, so as not to measure the temperature of the lubricant. The values are shown in Tables I and II.

TABLE I

| Sample No. | Upper row: surface temperature of reduction roll(° C.) Lower row: difference in temperature between two points (° C.) Measurement point (mm) 50 | 160 | 260 | Maximum temperature − minimum temperature |
|---|---|---|---|---|
| 1 | 253 | 241 | 252 | 12 |
| | 12 | | 11 | |
| 2 | 251 | 243 | 250 | 8 |
| | 8 | | 7 | |
| 3 | 249 | 247 | 250 | 3 |
| | 2 | | 3 | |
| 4 | 251 | 251 | 250 | 1 |
| | 0 | | 1 | |
| 5 | 223 | 210 | 221 | 13 |
| | 13 | | 11 | |
| 6 | 220 | 213 | 220 | 7 |
| | 7 | | 7 | |
| 7 | 222 | 224 | 222 | 2 |
| | 2 | | 2 | |
| 8 | 223 | 224 | 223 | 1 |
| | 1 | | 1 | |

TABLE II

| Sample No. | Upper row: surface temperature of rolled Mg alloy sheet (° C.) Lower row: difference in temperature between two points (° C. .) Measurement point (mm) 50 | 160 | 260 | Maximum temperature − minimum temperature |
|---|---|---|---|---|
| 1 | 255 | 246 | 255 | 9 |
| | 9 | | 9 | |
| 2 | 253 | 246 | 252 | 7 |
| | 7 | | 6 | |
| 3 | 251 | 249 | 252 | 3 |
| | 2 | | 3 | |
| 4 | 252 | 253 | 251 | 2 |
| | 1 | | 2 | |
| 5 | 222 | 212 | 223 | 11 |
| | 10 | | 11 | |
| 6 | 223 | 216 | 222 | 7 |
| | 7 | | 6 | |
| 7 | 223 | 226 | 224 | 3 |
| | 3 | | 2 | |
| 8 | 224 | 225 | 224 | 1 |
| | 1 | | 1 | |

[Evaluation of Mechanical Properties]

For samples 1 to 8 composed of the rolled Mg alloy materials obtained after rolling, the following properties were evaluated.

[Basal Plane Peak Ratio]

A basal plane peak ratio of each of samples 1 to 8 was measured on the basis of X-ray diffraction peak intensities. In this measurement, X-ray diffractometry was conducted at positions 50 mm (edge portion), 160 mm (central portion), and 260 mm (edge portion) from an edge in the width direction on a surface of each sample to determine the peak intensities of the (002) plane, the (100) plane, the (101) plane, the (102) plane, the (110) plane, and the (103) plane. A basal plane peak ratio $O_E$ of the edge portion and a basal plane peak ratio $O_C$ of the central portion were determined from the results, and a ratio $O_E/O_C$ was also determined. The basal plane peak ratios $O_C$ and $O_E$ are represented by the following formulae:

$$\text{Basal plane peak ratio } O_C: I_C(002)/\{I_C(100)+I_C(002)+I_C(101)+I_C(102)+I_C(110)+I_C(103)\}$$

$$\text{Basal plane peak ratio } O_E: I_E(002)/\{I_E(100)+I_E(002)+I_E(101)+I_E(102)+I_E(110)+I_E(103)\}$$

In the above formulae, $I_C(002)$, $I_C(100)$, $I_C(101)$, $I_C(102)$, $I_C(110)$, and $I_C(103)$ represent X-ray diffraction peak intensities of the above respective planes in the central portion, and $I_E(002)$, $I_E(100)$, $I_E(101)$, $I_E(102)$, $I_E(110)$, and $I_E(103)$ represent X-ray diffraction peak intensities of the above respective planes in the edge portion.

The results are shown in Table III.

[Average Grain Size]

An average grain size of each of samples 1 to 8 was measured in accordance with "Steels-Micrographic determination of the grain size JIS G 0551 (2005)". This measurement was conducted at positions 50 mm (edge portion), 160 mm (central portion), and 260 mm (edge portion) from an edge in the width direction of a cross section orthogonal to the rolling direction of each sample. An average grain size ratio $D_E/D_C$ of the average grain size of the edge portion to the average grain size of the central portion was determined from the results. The results are shown in Table III.

[Tensile Test]

An elongation, a tensile strength, and a 0.2% proof stress of each of samples 1 to 8 were measured in accordance with "Method of tensile test for metallic materials JIS Z 2241 (1998)". In this measurement, at positions 50 mm (edge portion), 160 mm (central portion), and 260 mm (edge portion) from an edge in the width direction of each sample, a JIS No. 13B specimen (JIS Z 2201 (1998)) was cut so that the longitudinal direction of the specimen corresponded to the rolling direction, and the tensile test was performed using the specimen. An elongation ratio $E_E/E_C$, a tensile strength ratio $Ts_E/Ts_C$, and a 0.2% proof stress ratio $Ps_E/Ps_C$ of the edge portion to the central portion were respectively determined from the results. The results are shown in Table IV.

[Press Test]

Samples 1 to 8 are each pressed with a pressing machine. The press is performed by placing a sample on a lower die having a square-bracket-shaped recess so as to cover the recess, and pressing a rectangular parallelepiped upper die onto the sample. The upper die has a rectangular parallelepiped shape of 50 mm×90 mm. Four sides of the upper die that contact the sample are rounded, and each of the sides has a certain bend radius. A heater and a thermocouple were embedded in each of the upper die and the lower die so that the temperature conditions during pressing could be adjusted to a desired temperature. Plastic working was conducted near the two edge portions and along the rolling direction, thus obtaining a shaped product whose portions near two facing sides were each bent at a substantially right angle and which had a square-bracket-shaped cross section.

TABLE III

| Sample | Basal plane peak ratio Measurement point (mm) | | | Ratio of basal plane peak ratio ($O_E/O_C$) | | Grain size Measurement point (mm) | | | Grain size ratio ($D_E/D_C$) | |
|---|---|---|---|---|---|---|---|---|---|---|
| No. | 50 | 160 | 260 | 50/160 | 260/160 | 50 | 160 | 260 | 50/160 | 260/160 |
| 1 | 0.858 | 0.980 | 0.859 | 0.876 | 0.877 | 5.8 | 3.8 | 5.8 | 1.53 | 1.53 |
| 2 | 0.859 | 0.978 | 0.858 | 0.878 | 0.877 | 5.9 | 3.9 | 5.8 | 1.51 | 1.49 |
| 3 | 0.863 | 0.871 | 0.864 | 0.991 | 0.992 | 5.3 | 4.9 | 5.4 | 1.08 | 1.10 |
| 4 | 0.862 | 0.865 | 0.863 | 0.997 | 0.998 | 5.5 | 5.6 | 5.6 | 0.98 | 1.00 |
| 5 | 0.709 | 0.800 | 0.710 | 0.886 | 0.888 | 6.2 | 4.1 | 6.2 | 1.51 | 1.51 |
| 6 | 0.701 | 0.798 | 0.699 | 0.878 | 0.876 | 6.3 | 4.2 | 6.1 | 1.50 | 1.45 |
| 7 | 0.715 | 0.721 | 0.714 | 0.992 | 0.990 | 5.8 | 5.6 | 5.7 | 1.04 | 1.02 |
| 8 | 0.713 | 0.716 | 0.713 | 0.996 | 0.996 | 5.7 | 5.7 | 5.6 | 1.00 | 0.98 |

TABLE IV

| Sample | 0.2% Proof stress (MPa) Measurement point (mm) | | | 0.2% proof stress ratio ($Ps_E/Ps_C$) | | Tensile strength (MPa) Measurement point (mm) | | | Tensile strength ratio ($Ts_E/Ts_C$) | | Elongation (%) Measurement point (mm) | | | Elongation ratio ($E_E/E_C$) | |
|---|---|---|---|---|---|---|---|---|---|---|---|---|---|---|---|
| No. | 50 | 160 | 260 | 50/160 | 260/160 | 50 | 160 | 260 | 50/160 | 260/160 | 50 | 160 | 260 | 50/160 | 260/160 |
| 1 | 248 | 278 | 249 | 0.892 | 0.896 | 324 | 366 | 329 | 0.885 | 0.899 | 12.0 | 7.0 | 11.0 | 1.71 | 1.57 |
| 2 | 247 | 276 | 248 | 0.895 | 0.899 | 322 | 364 | 326 | 0.885 | 0.896 | 12.0 | 7.5 | 11.0 | 1.60 | 1.47 |
| 3 | 248 | 251 | 247 | 0.988 | 0.984 | 329 | 330 | 331 | 0.997 | 1.003 | 12.0 | 11.0 | 11.0 | 1.09 | 1.00 |
| 4 | 250 | 252 | 251 | 0.992 | 0.996 | 332 | 329 | 330 | 1.009 | 1.003 | 10.0 | 12.0 | 11.0 | 0.83 | 0.92 |
| 5 | 220 | 248 | 219 | 0.887 | 0.883 | 278 | 318 | 278 | 0.874 | 0.874 | 18.0 | 11.5 | 17.5 | 1.57 | 1.52 |
| 6 | 221 | 246 | 218 | 0.898 | 0.886 | 279 | 316 | 280 | 0.883 | 0.886 | 18.0 | 11.5 | 17.0 | 1.57 | 1.48 |
| 7 | 218 | 221 | 217 | 0.986 | 0.982 | 279 | 284 | 281 | 0.982 | 0.989 | 18.0 | 18.0 | 19.0 | 1.00 | 1.06 |
| 8 | 220 | 222 | 221 | 0.991 | 0.995 | 280 | 283 | 281 | 0.989 | 0.993 | 19.0 | 18.0 | 19.0 | 1.06 | 1.06 |

[Results]

According to the results of the press test, no breaking or cracks were observed in the edge portions of samples 1 to 8. However, according to the results of the tensile test, in particular regarding samples 1 and 5, the tensile strength of the central portion was also high as compared with samples 3, 4, 7, and 8. That is, samples 1 and 5 were rolled materials whose two edge portions were easily subjected to plastic working and whose central portion had a high strength.

[Conclusion]

It was found that when a Mg alloy material is rolled, by increasing a difference in temperature over the width direction of a surface of a reduction roll to vary the rolled state in the width direction, the mechanical properties are locally varied in the width direction. It was also found that a rolled Mg alloy material whose mechanical properties are locally different in the width direction is obtained by varying the rolled state in this manner.

It is to be understood that the embodiments described above can be appropriately changed without departing from the gist of the present invention, and are not limited to the configurations described above.

INDUSTRIAL APPLICABILITY

The rolled Mg alloy material of the present invention can be suitably used in structural members that are locally subjected to plastic working. The method for producing a rolled Mg alloy material of the present invention can be suitably employed in the production of a rolled Mg alloy material whose mechanical properties are locally different in the width direction and which locally has good plastic workability only in a portion to be subjected to plastic working.

REFERENCE SIGNS LIST

1 Mg alloy material sheet
2, 2*a*, 2*b* heat box
3 reduction roll
4*bf*, 4*bb*, 4*r* temperature sensor
10, 10*a*, 10*b* reel

The invention claimed is:

1. A rolled magnesium alloy material produced by rolling a magnesium alloy material with a reduction roll, wherein the magnesium alloy material contains aluminum in an amount of 8.3% by mass or more and 12% by mass or less, wherein, in a width direction of the rolled magnesium alloy material, a ratio $O_E/O_C$ of a basal plane peak ratio of an edge portion to a basal plane peak ratio of a central portion satisfies $O_E/O_C<0.89$, where the basal plane peak ratio $O_C$ of the central portion and the basal plane peak ratio $O_E$ of the edge portion are represented by formulae below:

$$\text{basal plane peak ratio } O_C: I_C(002)/\{I_C(100)+I_C(002)+I_C(101)+I_C(102)+I_C(110)+I_C(103)\}$$

$$\text{basal plane peak ratio } O_E: I_E(002)/\{I_E(100)+I_E(002)+I_E(101)+I_E(102)+I_E(110)+I_E(103)\}$$

where $I_C(002)$, $I_C(100)$, $I_C(101)$, $I_C(102)$, $I_C(110)$, and $I_C(103)$ respectively represent X-ray diffraction peak intensities of a (002) plane, a (100) plane, a (101) plane, a (102) plane, a (110) plane, and a (103) plane in the central portion, and $I_E(002)$, $I_E(100)$, $I_E(101)$, $I_E(102)$, $I_E(110)$, and $I_E(103)$ respectively represent X-ray diffraction peak intensities of the (002) plane, the (100) plane, the (101) plane, the (102) plane, the (110) plane, and the (103) plane in the edge portion, wherein a thickness ratio $t_E/t_C$ satisfies $0.97 \leq t_E/t_C \leq 1.03$ where $t_C$ denotes a thickness of a central portion in the width direction of the rolled Mg alloy material and $t_E$ denotes a thickness of an edge portion in the width direction of the rolled Mg alloy material, wherein an elongation ratio $E_E/E_C$ of the edge portion to the central portion satisfies $3/2<E_E/E_C$, where $E_C$ denotes an elongation of the central portion in a tensile test in a rolling direction and $E_E$ denotes an elongation of the edge portion in a tensile test in a rolling direction.

2. The rolled magnesium alloy material according to claim 1, wherein a tensile strength ratio $Ts_E/Ts_C$ of the edge portion to the central portion satisfies $Ts_E/Ts_C<0.9$, where $Ts_C$ denotes a tensile strength of the central portion in a tensile test in a rolling direction and $Ts_E$ denotes a tensile strength of the edge portion in a tensile test in a rolling direction.

3. The rolled magnesium alloy material according to claim 1, wherein a 0.2% proof stress ratio $Ps_E/Ps_C$ of the edge portion to the central portion satisfies $Ps_E/Ps_C<0.9$, where $Ps_C$ denotes a 0.2% proof stress of the central portion in a tensile test in a rolling direction and $Ps_E$ denotes a 0.2% proof stress of the edge portion in a tensile test in a rolling direction.

4. The rolled magnesium alloy material according to claim 1, wherein an average grain size ratio $D_E/D_C$ of the edge portion to the central portion satisfies $3/2<D_E/D_C$, where $D_C$ denotes an average grain size of the central portion of a cross section orthogonal to a rolling direction and $D_E$ denotes an average grain size of the edge portion of a cross section orthogonal to a rolling direction.

5. A magnesium alloy structural member produced by plastically working the rolled magnesium alloy material according to claim 1.

* * * * *